US008918015B2

(12) United States Patent
Sakakibara et al.

(10) Patent No.: US 8,918,015 B2
(45) Date of Patent: Dec. 23, 2014

(54) MAIN CARTRIDGE, PROCESS CARTRIDGE, AND IMAGE FORMING APPARATUS

(71) Applicant: Canon Kabushiki Kaisha, Tokyo (JP)

(72) Inventors: Yuichi Sakakibara, Hadano (JP); Takashi Akutsu, Odawara (JP); Ken Kikuchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 13/711,491

(22) Filed: Dec. 11, 2012

(65) Prior Publication Data

US 2013/0149004 A1 Jun. 13, 2013

(30) Foreign Application Priority Data

Dec. 13, 2011 (JP) ..... 2011-272759

(51) Int. Cl.
*G03G 21/18* (2006.01)

(52) U.S. Cl.
CPC ..... *G03G 21/1846* (2013.01)
USPC ..... 399/113; 399/111

(58) Field of Classification Search
USPC ..... 399/113, 110, 119, 120, 111
See application file for complete search history.

(56) References Cited

U.S. PATENT DOCUMENTS

| | | | | |
|---|---|---|---|---|
| 8,639,164 | B2 * | 1/2014 | Kuge et al. | 399/120 X |
| 2003/0039484 | A1 * | 2/2003 | Naito et al. | 399/113 |
| 2009/0214249 | A1 * | 8/2009 | Lee et al. | 399/113 X |
| 2011/0064457 | A1 * | 3/2011 | Okabe et al. | 399/110 |
| 2011/0158681 | A1 * | 6/2011 | Kikuchi et al. | 399/111 |
| 2013/0016995 | A1 * | 1/2013 | Hiramatsu et al. | 399/119 |

FOREIGN PATENT DOCUMENTS

| | | |
|---|---|---|
| JP | 2002-311709 A | 10/2002 |
| JP | 2003-208074 A | 7/2003 |

* cited by examiner

*Primary Examiner* — Sophia S Chen
(74) *Attorney, Agent, or Firm* — Canon USA Inc IP Division

(57) ABSTRACT

A main cartridge attachable and detachable to and from an apparatus body of an image forming apparatus for forming an image on a recording medium is provided. The main cartridge include a process device configured to act on a photosensitive member, a grip portion configured to be held by a user, and an attachment unit to attach a sub cartridge containing developer along the longitudinal direction of the main cartridge. In the longitudinal direction, the center position of the grip portion is disposed at the upstream side in the attachment direction of the sub cartridge from the center position of the main cartridge.

26 Claims, 7 Drawing Sheets

MAIN CARTRIDGE, PROCESS CARTRIDGE, AND IMAGE FORMING APPARATUS

BACKGROUND OF THE INVENTION

1. Field of the Invention

The present invention relates to a main cartridge attachable and detachable to and from an electrophotographic image forming apparatus, and a process cartridge. The present invention also relates to an image forming apparatus having the process cartridge.

The electrophotographic image forming apparatuses form an image on a recording medium using an electrophotographic image forming process. The electrophotographic image forming apparatuses include, for example, electrophotographic copying machines, electrophotographic printers (for example, laser beam printers and light-emitting diode (LED) printers), electrophotographic facsimile apparatuses, and electrophotographic word processors.

The recording media on which an image is formed by an electrophotographic image forming apparatus include, for example, paper and overhead projector (OHP) sheets.

The process cartridge is detachably attached to the main body of an electrophotographic image forming apparatus. The process cartridge is provided with at least one process device used in an image forming process for forming an image on a recording medium. The process cartridge and the process device are integrated as a cartridge. The electrophotographic process devices include charging devices, development devices, and cleaning devices.

2. Description of the Related Art

The above-described cartridge is replaced by the user when the user attaches the cartridge to the apparatus main body or when the cartridge reaches its end of life. In the replacement of the cartridge by the user, a grip portion can be provided for the user to surely hold the cartridge. For example, Japanese Patent Application Laid-Open No. 2003-208074 discussed this type of a grip. In Japanese Patent Application Laid-Open No. 2003-208074, in attaching the cartridge to the apparatus body, the user holds the grip portion protruding from a frame body of the cartridge, and inserts the cartridge into the apparatus along a guiding portion of the apparatus body. When the user removes the cartridge from the apparatus body, the user holds the grip portion with hands, and takes it out of the apparatus. The grip portion provided in the cartridge enables the user to easily attach and detach the cartridge to and from the apparatus body.

Further, in a technique discussed in Japanese Patent Application Laid-Open No. 2002-311709, the attachment and detachment directions of a cartridge containing toner is orthogonal to the attachment and detachment directions of a developing unit. In contrast to a mechanism in which the attachment and detachment directions of the toner unit and the development unit are the same, the fixation releasing mechanism of the development unit can be omitted.

The cartridge may be further separated into a plurality of cartridges, and in such cartridges, one cartridge is referred to as a main cartridge and the other cartridge detachably provided to the main cartridge is referred to as a sub cartridge. In Japanese Patent Application Laid-Open No. 2002-311709, the development unit (development cartridge) is the main cartridge, and the toner unit (toner cartridge) is the sub cartridge. Among mechanisms attaching and detaching the sub cartridge in the longitudinal direction of the main cartridge, a case that the grip portion is provided in the whole longitudinal direction of the main cartridge as discussed in Japanese Patent Application Laid-Open No. 2002-311709 is described.

In the case where the grip portion is provided in the whole longitudinal direction of the main cartridge, the portions held by the user vary. Depending on the portions in the grip portion held by the user, the balance in the longitudinal direction can be lost, which makes it hard to grip. Moreover, if the grip portion is provided at a central portion of the main cartridge in the longitudinal direction, when the user attaches the sub cartridge, the distance between the position of the grip portion of the main cartridge and the position of the sub cartridge held by the user increases. As a result, especially in a case of a large cartridge, the attachment and detachment operation of the main cartridge and the sub cartridge can become difficult.

SUMMARY OF THE INVENTION

The present invention is directed to providing a main cartridge excellent in usability, to or from which a sub cartridge can be easily attached or detached. The present invention is also directed to providing a process cartridge provided with such a sub cartridge and main cartridge, and an image forming apparatus provided with the process cartridge.

According to an aspect of the present invention, a main cartridge includes a process device configured to act on a photosensitive member, a grip portion configured to be held by a user, and an attachment unit to attach a sub cartridge containing developer along the longitudinal direction of the main cartridge. In the longitudinal direction, the center position of the grip portion is disposed at the upstream side in the attachment direction of the sub cartridge from the center position of the main cartridge.

According to another aspect of the present invention, s process cartridge includes a main cartridge attachable and detachable to and from the apparatus body of the image forming apparatus, and a sub cartridge attachable and detachable to and from the main cartridge. The sub cartridge includes a developer container containing developer to be supplied to the main cartridge. The main cartridge includes a process device acting on a photosensitive member, a grip portion to be held by a user, and an attachment portion to attach the sub cartridge along the longitudinal direction of the main cartridge. In the longitudinal direction, the center position of the grip portion is disposed at the upstream side in the sub cartridge attachment direction from the center position of the main cartridge.

According to yet another aspect of the present invention, an image forming apparatus includes the process cartridge.

According to yet another aspect of the present invention, an image forming apparatus includes a conveyance device configured to convey the recording medium, and a process cartridge including a main cartridge attachable and detachable to and from the apparatus body of the image forming apparatus, and a sub cartridge attachable and detachable to and from the main cartridge. The sub cartridge includes a developer container containing developer to be supplied to the main cartridge. The main cartridge includes a process device acting on a photosensitive member, a grip portion to be held by a user, and an attachment portion to attach the sub cartridge along the longitudinal direction of the main cartridge. In the longitudinal direction, the center position of the grip portion is disposed at the upstream side in the sub cartridge attachment direction with respect to the center position of the main cartridge.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 5A is a perspective view illustrating the structure of the cartridge according to the second exemplary embodiment. FIG. 5B illustrates an attachment direction of the sub cartridge according to the second exemplary embodiment. FIG. 5C is a cross sectional view illustrating a main cartridge according to the second exemplary embodiment.

DESCRIPTION OF THE EMBODIMENTS

Various exemplary embodiments, features, and aspects of the invention will be described in detail below with reference to the drawings.

Hereinafter, a process cartridge and an electrophotographic image forming apparatus according to the first exemplary embodiment of the present invention are described with reference to the attached drawings.

(Overall Structure of Image Forming Apparatus)

An electrophotographic image forming apparatus having an attachable and detachable process cartridge according to the exemplary embodiment of the present invention is described. The electrophotographic image forming apparatus forms an image on a recording medium such as record paper, an OHP sheet, and fabric using an electrophotographic image forming process. The process cartridge includes a process device that acts on a photosensitive member. The process cartridge is detachably attached to the apparatus body of the electrophotographic image forming apparatus. The apparatus body is an image forming apparatus portion not including the cartridge.

The electrophotographic image forming apparatus can be, for example, an electrophotographic copying machine, an electrophotographic printer (for example, an LED printer and a laser beam printer), an electrophotographic facsimile apparatus, and an electrophotographic word processor. In the exemplary embodiment, an electrophotographic laser beam printer is described.

Figure 3:
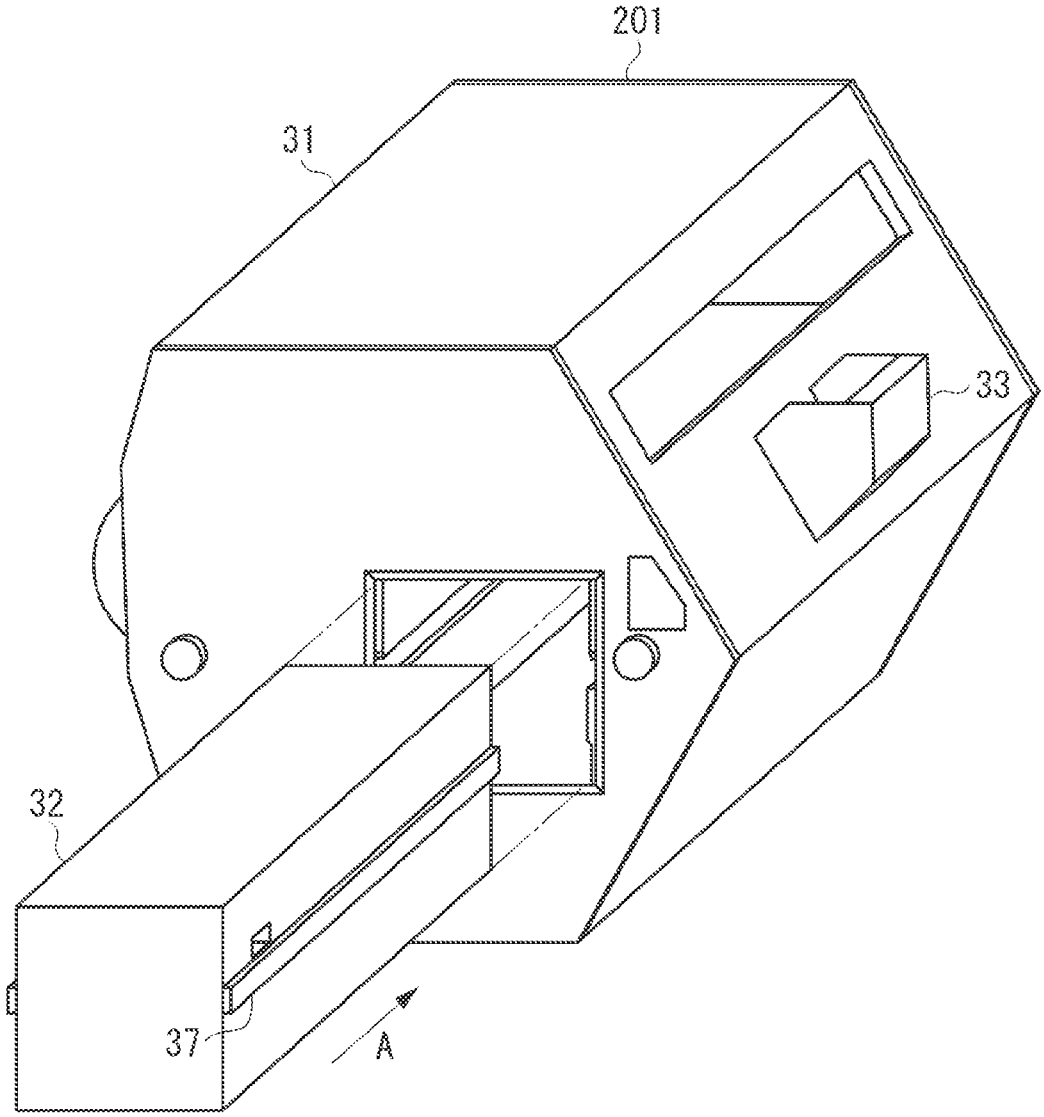
FIG. 3 illustrates a structure of the cartridge according to the first exemplary embodiment.

As illustrated in FIGS. 1 and 3, a process cartridge 201 according to the exemplary embodiment is a separable cartridge that can be divided into a main cartridge 31 and a sub cartridge 32. The cartridge that can be detached from the apparatus body is referred to as a main cartridge, and the cartridge that can be detached from the main cartridge is referred to as a sub cartridge. In other words, the sub cartridge 32 can be attached and detached to and from the main cartridge 31. In the exemplary embodiment, the main cartridge 31 includes electrophotographic process devices such as a photosensitive drum, a charging device, a development device, and a drum cleaning device. The sub cartridge 32 includes a toner container 14 that serves as a developer container for containing toner (developer) supplied to the main cartridge 31. The sub cartridge 32 can be attached and detached to and from the main cartridge 31.

In the exemplary embodiment, the attachment direction A of the sub cartridge 32 is parallel to the longitudinal direction (the longitudinal direction of the photosensitive drum 1) of the main cartridge 31. In the description below, the expression "longitudinal direction" means the longitudinal direction of the main cartridge 31.

The process cartridge 201 can include the main cartridge 31 having the photosensitive drum and the cleaning device, and the sub cartridge 32 having the development device and the toner container 14. Alternatively, the main cartridge 31 can omit the photosensitive drum, and include the development device, and the sub cartridge 32 can include the toner container 14.

Figure 2A:
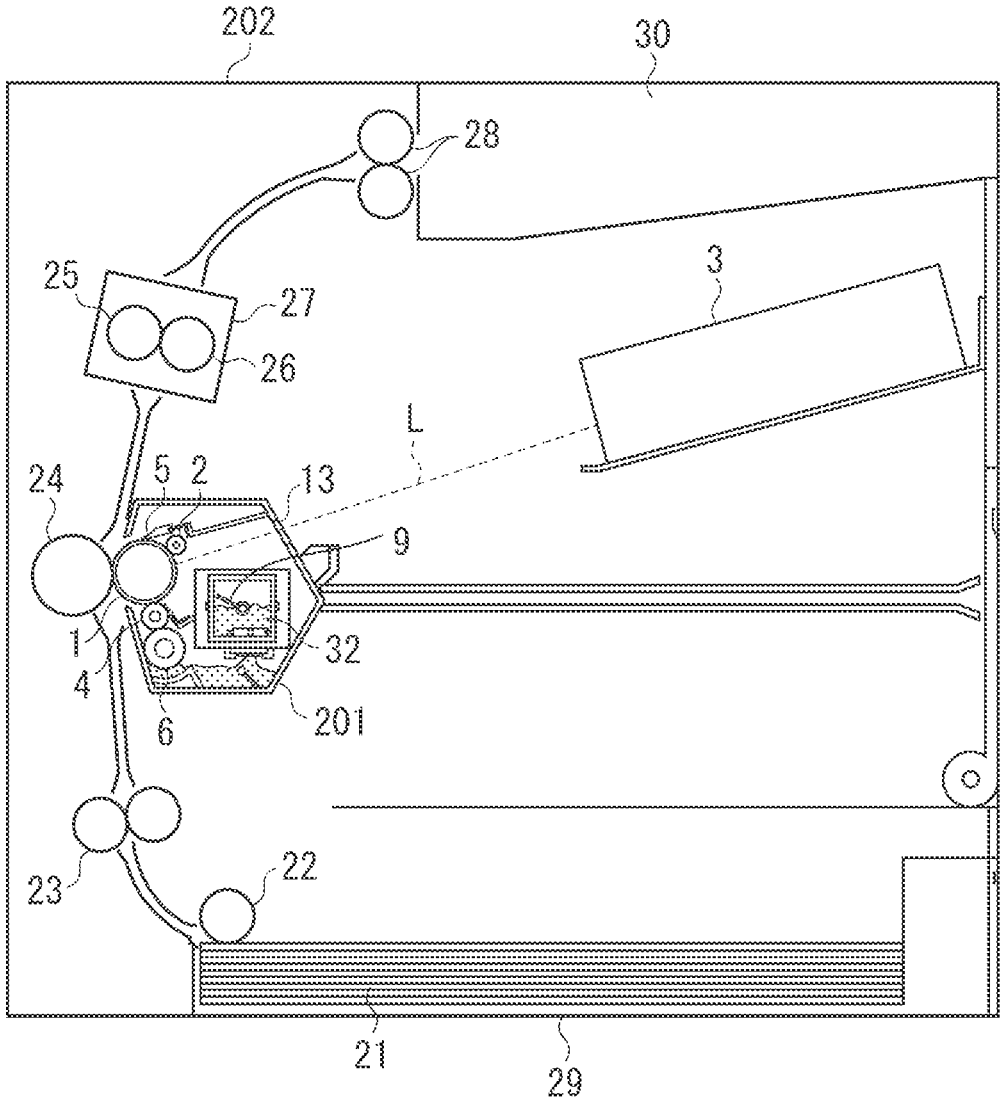
FIGS. 2A and 2B illustrate a concept of an image forming apparatus and a process cartridge according to the first exemplary embodiment.
Figure 2B:
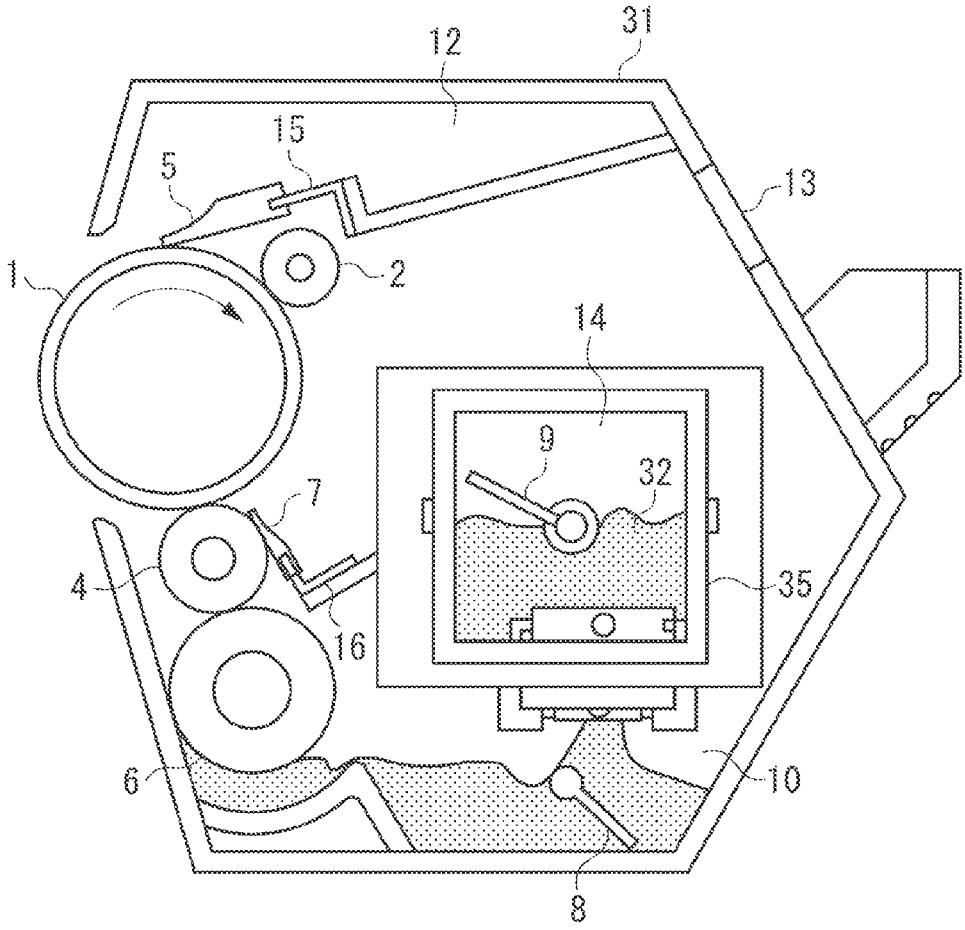

With reference to FIG. 2A, the image forming process is described. The surface of the photosensitive drum 1 that serves as an image carrier is uniformly charged by a charging roller 2. The charging roller 2 serves as a charging device driven and rotated to the photosensitive drum 1. Laser beam light L corresponding to image information is emitted from an optical device 3 via an aperture exposure portion 13 onto the photosensitive drum 1, and an electrostatic latent image corresponding to the image information is formed on the photosensitive drum 1.

The rotation of a toner sending member 9 in the sub cartridge 32 sends the toner in the toner container 14 in the sub cartridge 32 to a toner container 10 in the main cartridge 31. Further the rotation of a toner sending member 8 in the main cartridge 31 sends the toner to an application roller 6 that serves as a toner application member. The toner sent to the application roller 6 is supplied from the application roller 6 to the development roller 4 that serves as a developer bearing member.

The thickness of the toner on the development roller 4 is regulated by a development blade 7 supported by a development blade sheet metal 16. On the surface of the development roller 4, a toner layer is formed. On the toner on the development roller 4, frictional electrification is performed by the development blade 7 and the application roller 6, and the toner is negatively charged. The rotation of the development roller 4 supplies the toner onto a development area where the photosensitive drum 1 and the development roller 4 face each other.

The toner corresponding to the electrostatic latent image is transferred onto the photosensitive drum 1, and thereby a toner image is formed and visualized. The development device in the exemplary embodiment includes the development roller 4, the application roller 6, the development blade 7, the development blade sheet metal 16, and the like.

To a transfer roller 24, voltage of the polarity opposite to that of the toner forming the toner image is applied, and the toner image formed on the photosensitive drum 1 is transferred onto a recording medium 21. The cleaning device 5 removes the toner remaining on the photosensitive drum 1. The cleaning device rubs the residual toner away from the photosensitive drum 1 with an elastic cleaning blade 5 contacting the photosensitive drum 1, and collects the toner in a waste toner container 12. The cleaning blade 5 is supported by a cleaning blade sheet metal 15.

Meanwhile, in synchronization with the toner image formation, the recording medium 21 set on a sheet cassette 29 is conveyed to the transfer position with a pickup roller 22 and a conveyance roller pair 23, and the toner image is transferred from the photosensitive drum 1 onto the recording medium 21. The pickup roller 22 and the conveyance roller pair 23 serve as a conveyance device for the recording medium.

The recording medium 21 on which the toner image is transferred is conveyed to a fixing device 27. The fixing device 27 includes a drive roller 25 and a fixing roller 26 having a heater in the roller. The fixing device 27 applies heat and pressure onto the passing recording medium 21 to form a transfer toner image. The recording medium 21 is discharged onto a discharge tray 30 with a discharge roller pair 28.

The process cartridge 201 can be attached and detached to and from an image forming apparatus 202 by the operator.

(Structure of Main Cartridge)

Figure 4A:
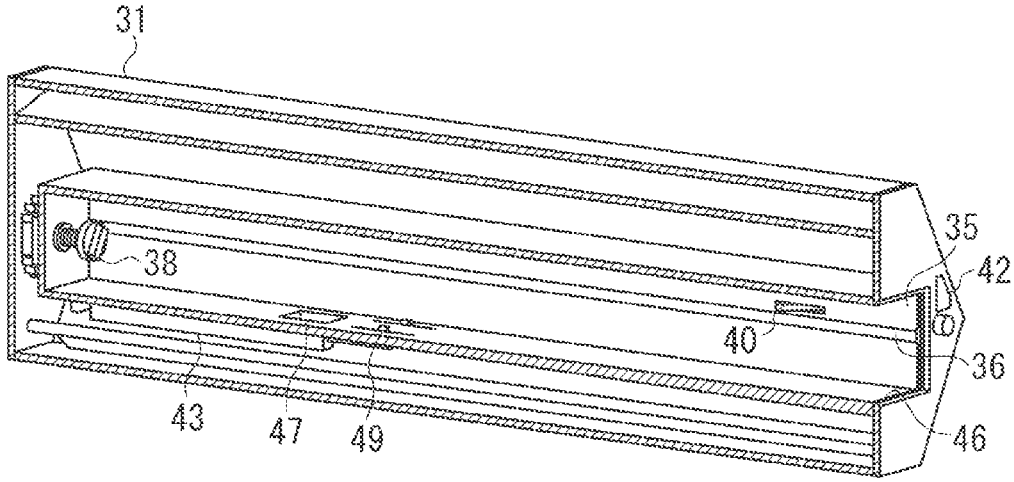
FIG. 4A is a cross-sectional view illustrating a structure of a main cartridge according to the first exemplary embodiment.

With reference to FIG. 4A, a basic structure of the main cartridge 31 is described. FIG. 4A is a cross-sectional view of the main cartridge.

The main cartridge 31 includes a sub cartridge attachment unit 35 that can attach the sub cartridge 32. At the entrance of the sub cartridge attachment unit 35, an opening 46 is provided.

The sub cartridge attachment unit 35 includes a guiding portion 36 used to guide the sub cartridge 32. The guiding portion 36 is also provided at a position opposite to the position illustrated in the drawing with respect to the sub cartridge attachment unit 35.

The sub cartridge attachment unit 35 includes a toner reception port 47 that is an opening for supplying the toner from the sub cartridge 32 to the main cartridge 31, and a main cartridge side toner shutter 43 that is urged by a spring at a close position. A trigger member 49 slides in the attachment and detachment directions of the sub cartridge 32 integrally with the main cartridge side toner shutter 43. A trigger member 50 of the sub cartridge 32 in FIG. 4B contacts the trigger member 49 of the main cartridge 31 in an attachment operation of the sub cartridge 32.

In response to the contact, the main cartridge side toner shutter 43 of the main cartridge 31 and a sub cartridge side toner shutter 44 of the sub cartridge 32 simultaneously open. As a result, the toner supply path from the sub cartridge 32 to the main cartridge 31 is released, and the toner can be supplied from the sub cartridge 32 to the main cartridge 31.

A coupling 38 for transmitting a driving force from the main cartridge 31 to the toner sending member 9 in the sub cartridge 32 is provided in the sub cartridge attachment unit 35 of the main cartridge 31.

Further, a stopper member 40 that rotates in conjunction with a switch 42 is provided in the sub cartridge attachment unit 35.

(Structure of Sub Cartridge)

Figure 4B:
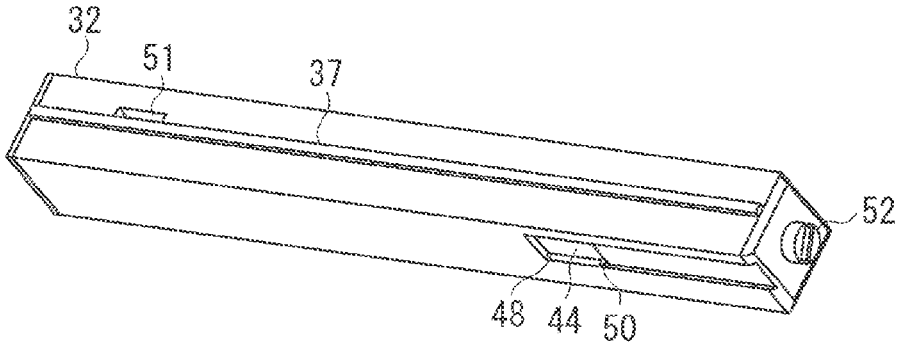
FIG. 4B illustrates a structure of a sub cartridge according to the first exemplary embodiment.

With reference to FIG. 4B, a basic structure of the sub cartridge 32 is described. FIG. 4B illustrates a basic structure of the sub cartridge 32.

The sub cartridge 32 includes a portion 37 to be guided at a position corresponding to the guiding portion 36, which is the position opposite to the guiding portion 36 of the main cartridge 31.

A toner supply port 48 that is an opening for supplying the toner to the main cartridge 31 and a sub cartridge side toner shutter 44 are provided at positions corresponding to the toner reception port 47 of the main cartridge 31 and the main cartridge side toner shutter 43, respectively. Further, the trigger member 50 that slides integrally with the sub cartridge side toner shutter 44 is provided. The trigger member 50 is used to release the sub cartridge side toner shutter 44.

A coupling 52 for transmitting a driving force from the coupling 38 of the main cartridge 31 to the toner sending member 9 in the sub cartridge 32 is provided at the tip portion of the sub cartridge attachment unit 32. The toner sending member 9 and the coupling 52 are coupled such that the driving force can be transmitted.

At a position corresponding to the stopper member 40 of the main cartridge 31, an opening 51 that serves as a member to be stopped is provided. The stopper member 40 is fitted into the opening 51 and thereby the position of the sub cartridge 32 to the main cartridge 31 is fixed. The user presses a switch 42 provided in the main cartridge 31 and the stopper member 40 rotates. By the operation, the engagement of the stopper member 40 and the opening 51 is released. Consequently, when the user presses the switch 42, the sub cartridge 32 can be pulled from the main cartridge 31.

(Position of Grip Portion of Main Cartridge)

Figure 1A:
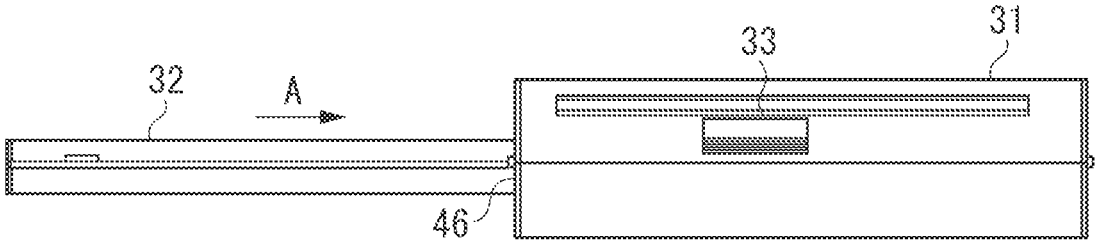
FIGS. 1A and 1B illustrate a structure of a cartridge according to the first exemplary embodiment.
Figure 1B:
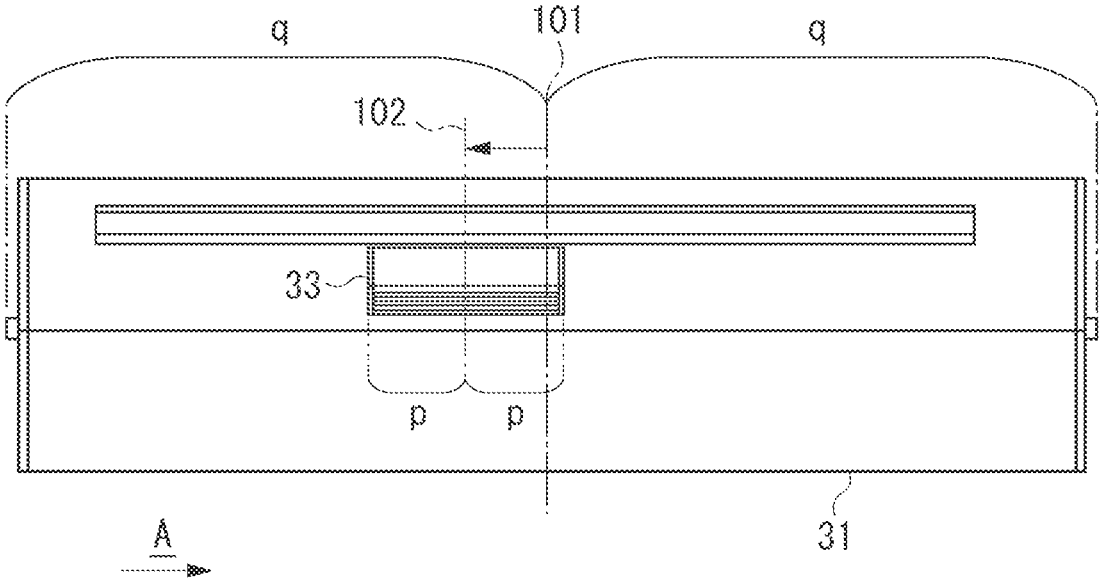

With reference to FIG. 1, a position of the grip portion of the main cartridge is described. In FIG. 1B, p and q indicate lengths, and portions having the same symbol are of equal length respectively.

As illustrated in FIG. 1A, the attachment direction A of the sub cartridge 32 is set to be parallel to the longitudinal direction of the main cartridge 31.

FIG. 1B illustrates the position of the grip portion 33 of the main cartridge 31 in the longitudinal direction.

The position 101 is a position where the distances from the both end portions of the main cartridge 31 are equal, and the position 101 is the center position of the main cartridge 31 in the longitudinal direction. The center position 102 is a position where the distances from the both end portions of the grip portion 33 of the main cartridge 31 are equal, and the position 102 is the center position of the grip portion 33 in the longitudinal direction.

As illustrated in FIG. 1B, with respect to the longitudinal direction, the center position 102 of the grip portion 33 is positioned at the upstream side in the attachment direction A of the sub cartridge 32 from the center position 101 of the main cartridge 31. In other words, as a feature of the exemplary embodiment, the center position 102 of the grip portion is provided closer to a position where the opening 46 for attaching the sub cartridge 32 is provided with respect to a direction.

In the exemplary embodiment of the present invention, when the sub cartridge 32 is attached or detached, the distance between both hands of the user holding the grip portion 33 of the main cartridge 31 with one hand and holding the sub cartridge 32 with the other hand is narrower than that of known mechanism. Consequently, the sub cartridge can be attached or detached with less power, and the process cartridge having a high degree of usability can be provided.

Figure 5A:
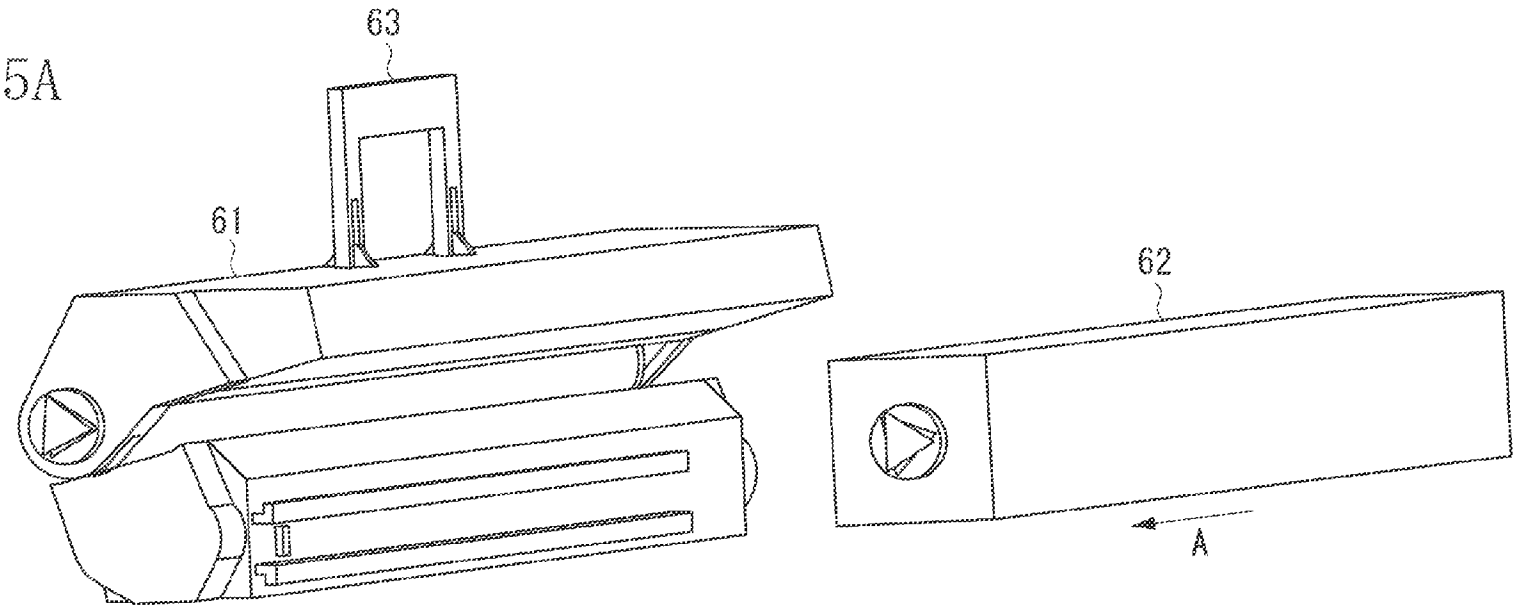
FIGS. 5A, 5B, and 5C illustrate a structure of a cartridge according to the second exemplary embodiment.
Figure 5B:
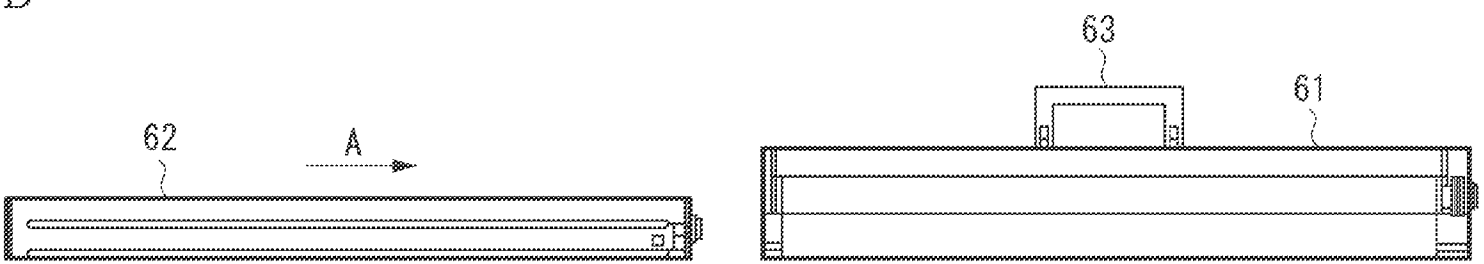
Figure 5C:
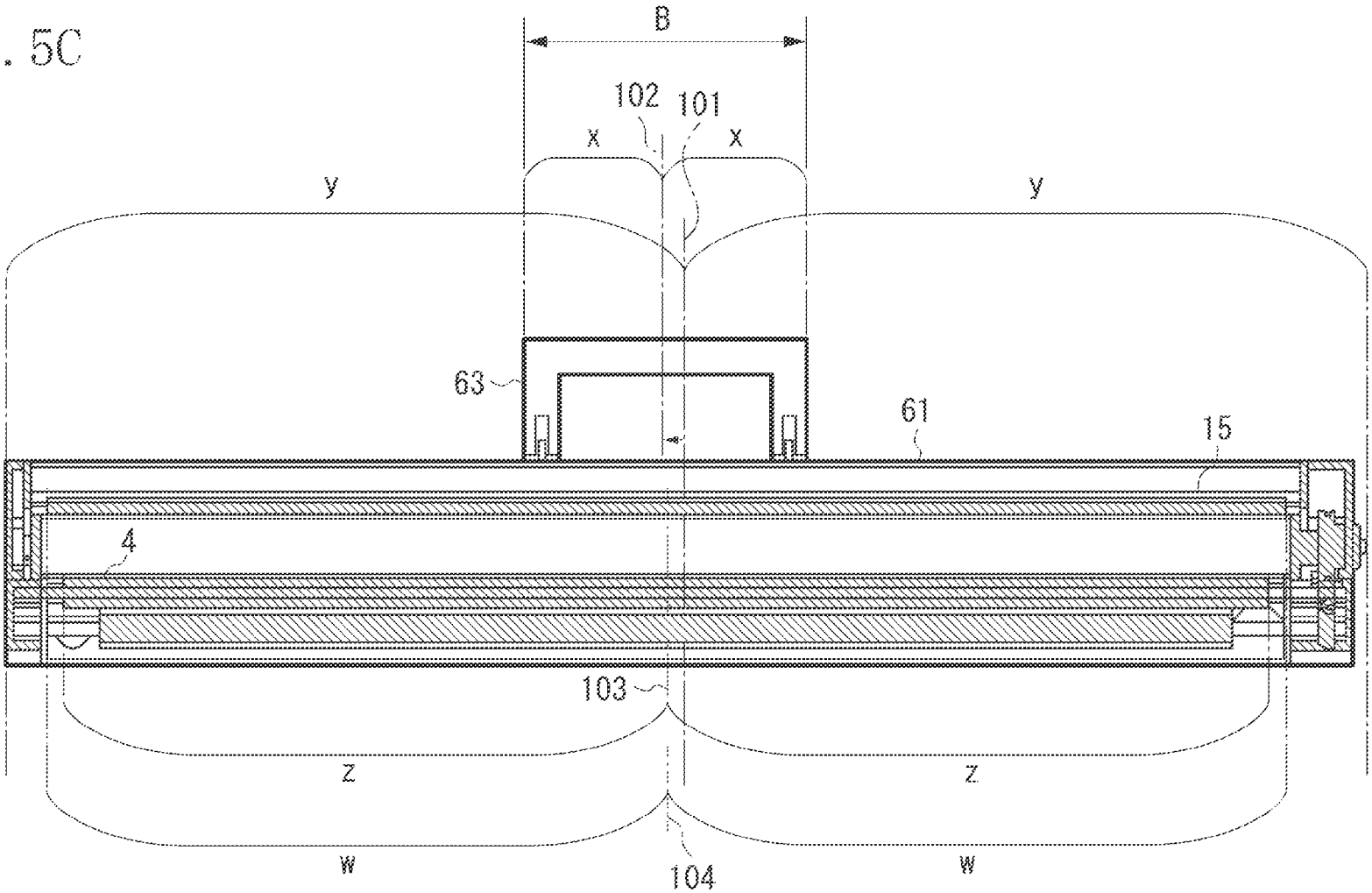

The process cartridge according to the second exemplary embodiment is described with reference to FIGS. 5A and 5B. In the description, only features different from those in the first exemplary embodiment are described. In the second exemplary embodiment, different from the first exemplary embodiment, the sub cartridge is not attached to the main cartridge, and a sub cartridge 62 is exposed. The other structures are similar to those in the first exemplary embodiment and their descriptions are omitted. FIG. 5A is a perspective view. FIG. 5B illustrates the attachment direction of the sub cartridge. FIG. 5C is a cross-sectional view illustrating the main cartridge in the longitudinal direction.

(Arrangement of Heavy Goods in Main Cartridge)

As illustrated in FIGS. 5A and 5B, a main cartridge 61 includes a grip portion 63. To the main cartridge, the sub cartridge 62 is attached from the attachment direction A.

In FIG. 5C, x, y, z and w indicate lengths, and portions of the same symbol are of equal length. The center position 102 is a position where the distances from the both end portions of the grip portion 63 of the main cartridge 61 are equal, and the center position 102 is the center position of the grip portion 63 in the longitudinal direction.

The center position 101 is a position where the distances from the both end portions of the main cartridge 61 are equal, and the center position 101 is the center position of the main cartridge 61 in the longitudinal direction. A center position 104 is a position where the distances from the both end portions of the cleaning blade sheet metal 15 are equal, and the center position 104 is the center position of the cleaning blade sheet metal 15 in the longitudinal direction.

A center position 103 is a position where the distances from the both end portions of the development roller 4 are equal, and the position 103 is the center position of the development roller 4 in the longitudinal direction. The center positions 103 and 104, and some other components are provided at the upstream side in the sub cartridge attachment direction A from the center position 101 of the main cartridge 61 in the longitudinal direction. Although not illustrated in FIG. 5C, the position (the center position of the development blade sheet metal 16) where the distances from the both end portions of the development blade sheet metal 16 are equal is also provided at the upstream side in the sub cartridge attachment direction A from the center position 101 of the main cartridge 61 in the longitudinal direction.

The structure enables the center of gravity of the main cartridge 61 in the longitudinal direction to shift to the attachment upstream side of the sub cartridge 62. It is preferable that the grip portion 63 of the main cartridge 61 is positioned at a position near the center of gravity of the main cartridge 61. If the position of the center of gravity is far from the position of the grip portion 63, the moment applied to the grip portion 63 increases, and as a result, the burden of the user holding the grip portion 63 can be excessive.

As described above, the center of gravity of the process cartridge is shifted to the upstream side in the attachment direction A from the center position 101 of the main cartridge 61, and this structure can shorten the distance between the position of the center of gravity and the position of the grip portion 63. As a result, the burden of the user can be reduced. In the exemplary embodiment, the development roller 4, the cleaning blade sheet metal 15, and the development blade sheet metal 16 are described as an example because these components are provided in the main cartridge 61 along the longitudinal direction, and the components are relatively heavy.

Preferably, the center of gravity of the main cartridge 61 where the sub cartridge 62 is attached, and the center of gravity where the sub cartridge 62 is not attached, are positioned within the both ends of the grip portion 63 in the longitudinal direction (the range B in FIG. 5C). Thus, the center of gravity of the main cartridge 61 can be positioned near the grip portion 63 even if the state of the main cartridge 61 is changed by detaching the sub cartridge 62 from the main cartridge 61, and as a result, the burden of the grip on the user can be reduced.

It is preferable that the center of gravity of the main cartridge 61 to which a new sub cartridge 62 fully filled with the developer in the developer container is attached, and the center of gravity of the main cartridge 61 to which a used sub cartridge 62 containing less developer as compared to the new one is attached, are positioned within the range B mentioned above. Therefore, the center of gravity of the main cartridge 61 can be positioned near the grip portion 63 irrespective of the amount of the developer in the developer container, and consequently, the burden of the grip on the user can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-272759, filed Dec. 13, 2011, which is hereby incorporated by reference herein in its entirety.

What is claimed is:

1. A main cartridge attachable and detachable to and from an apparatus body of an image forming apparatus for forming an image on a recording medium, the main cartridge comprising:

a process device configured to act on a photosensitive member;

a grip portion configured to be held by a user; and an attachment unit configured to attach sub cartridge containing developer along a longitudinal direction of the main cartridge, wherein, in the longitudinal direction, a center position of the grip portion is disposed at a upstream side in an attachment direction of the sub cartridge from a center position of the main cartridge, and wherein position of a center of gravity of the main cartridge is at the upstream side in the attachment direction than a center position of the main cartridge in the longitudinal direction.

2. The main cartridge according to claim 1, wherein the attachment unit includes an opening provided at an end portion of the main cartridge in the longitudinal direction, and a guiding portion for guiding the sub cartridge inserted from the opening along the longitudinal direction.

3. The main cartridge according to claim 1, wherein the process device is a development device for developing an electrostatic latent image, and the development device includes a developer bearing member for bearing the developer, and in the longitudinal direction, the center position of the developer bearing member is disposed at the upstream side in the sub cartridge attachment direction from a center position of the main cartridge.

4. The main cartridge according to claim 1, wherein the process device is a cleaning device for removing the developer on the photosensitive member, and the cleaning device includes a cleaning blade and a cleaning blade sheet metal for supporting the cleaning blade, and in the longitudinal direction, the center position of the cleaning blade sheet metal is disposed at the upstream side in the sub cartridge attachment direction from a center position of the main cartridge.

5. The main cartridge according to claim 1, wherein the process device is a development device for developing an electrostatic latent image, the development device includes a development blade for regulating the thickness of the layer of the developer on a developer bearing member bearing the developer and a development blade sheet metal for supporting the development blade, and in the longitudinal direction, a center position of the development blade sheet metal is disposed at the upstream side in the sub cartridge attachment direction from the center position of the main cartridge.

6. The main cartridge according to claim 1, wherein the main cartridge includes the photosensitive member.

7. A process cartridge used in an image forming apparatus, the process cartridge comprising:

a main cartridge attachable and detachable to and from the apparatus body of the image forming apparatus, and a sub cartridge attachable and detachable to and from the main cartridge, wherein the sub cartridge includes a developer container containing developer to be supplied to the main cartridge, the main cartridge includes a process device acting on a photosensitive member, a grip portion to be held by a user, and an attachment portion capable of attaching the sub cartridge along the longitudinal direction of the main cartridge, and in a longitudinal direction, a center position of the grip portion is disposed at an upstream side in a sub cartridge attachment direction from a center position of the main cartridge, and wherein position of a center of gravity of the main cartridge is at the upstream side in the attachment direction than a center position of the main cartridge in the longitudinal direction.

8. The process cartridge according to claim 7, wherein the attachment portion includes an opening provided at an end portion of the main cartridge in the longitudinal direction, and a guiding portion for guiding the sub cartridge inserted from the opening along the longitudinal direction.

9. The process cartridge according to claim 7, wherein the process device is a development device for developing an electrostatic latent image, and the development device includes a developer bearing member for bearing developer, and in the longitudinal direction, a center position of the developer bearing member is disposed at the upstream side in the sub cartridge attachment direction from the center position of the main cartridge.

10. The process cartridge according to claim 7, wherein the process device is a cleaning device for removing the developer on the photosensitive member, and the cleaning device includes a cleaning blade and a cleaning blade sheet metal for supporting the cleaning blade, and in the longitudinal direction, a center position of the cleaning blade sheet metal is disposed at the upstream side in the sub cartridge attachment direction from the center position of the main cartridge.

11. The process cartridge according to claim 7, wherein the process device is a development device for developing an electrostatic latent image, the development device includes a development blade for regulating the thickness of the layer of the developer on a developer bearing member bearing the developer and a developer blade sheet metal for supporting the development blade, and in the longitudinal direction, a center position of the development blade sheet metal is disposed at the upstream side in the sub cartridge attachment direction from the center position of the main cartridge.

12. The process cartridge according to claim 7, wherein a center of gravity of the main cartridge in the longitudinal direction where the sub cartridge is attached and a center of gravity of the main cartridge in the longitudinal direction where the sub cartridge is not attached are positioned inside both ends of the grip portion.

13. The process cartridge according to claim 7, wherein a center of gravity of the main cartridge in the longitudinal direction where a new sub cartridge having the developer container filled with the developer is attached, and a center of gravity of the main cartridge in the longitudinal direction where a used sub cartridge with a less amount of the filled developer than the new sub cartridge is attached, are positioned inside both ends of the grip portion.

14. The process cartridge according to claim 7, wherein the main cartridge includes the photosensitive member.

15. The process cartridge according to claim 7, wherein a whole sub cartridge is positioned in the main cartridge when the sub cartridge is attached to the attachment portion.

16. The process cartridge according to claim 7, wherein the sub cartridge is exposed from the main cartridge when the sub cartridge is attached to the attachment portion.

17. The process cartridge according to claim 7, wherein the sub cartridge includes a shutter configured to open and close the opening of the developer container, and the shutter opens in response to an attachment operation of the sub cartridge to the attachment portion of the main cartridge.

18. An image forming apparatus configured to form an image on a recording medium, the image forming apparatus comprising:

a conveyance device configured to convey the recording medium; and a process cartridge including a main cartridge attachable and detachable to and from an apparatus body of the image forming apparatus, and a sub cartridge attachable and detachable to and from the main cartridge, wherein the sub cartridge includes a developer container containing developer to be supplied to the main cartridge, the main cartridge includes a process device acting on a photosensitive member, a grip portion to be held by a user, and an attachment portion to attach the sub cartridge along a longitudinal direction of the main cartridge, and in the longitudinal direction, a center position of the grip portion is disposed at an upstream side in a sub cartridge attachment direction from a center position of the main cartridge, and wherein position of a center of gravity of the main cartridge is at the upstream side in the attachment direction than a center position of the main cartridge in the longitudinal direction.

19. The image forming apparatus according to claim 18, wherein the attachment portion includes an opening provided at an end portion of the main cartridge in the longitudinal direction, and a guiding portion for guiding the sub cartridge inserted from the opening along the longitudinal direction.

20. The image forming apparatus according to claim 18, wherein the process device is a development device for developing an electrostatic latent image, and the development device includes a developer bearing member for bearing developer, and in the longitudinal direction, a center position of the developer bearing member is disposed at the upstream side in the sub cartridge attachment direction from the center position of the main cartridge.

21. A main cartridge attachable and detachable to and from an apparatus body of an image forming apparatus for forming an image on a recording medium, the main cartridge comprising:

a process device configured to act on a photosensitive member;

a grip portion configured to be held by a user; and an attachment unit configured to attach sub cartridge containing developer along the longitudinal direction of the main cartridge, wherein, in the longitudinal direction, the center position of the grip portion is disposed at the upstream side in the attachment direction of the sub cartridge from the center position of the main cartridge, and the cleaning device includes a cleaning blade and a cleaning blade sheet metal for supporting the cleaning blade, and in the longitudinal direction, the center position of the cleaning blade sheet metal is disposed at the upstream side in the sub cartridge attachment direction from the center position of the main cartridge.

22. A main cartridge attachable and detachable to and from an apparatus body of an image forming apparatus for forming an image on a recording medium, the main cartridge comprising:

a process device configured to act on a photosensitive member;

a grip portion configured to be held by a user; and an attachment unit configured to attach sub cartridge containing developer along the longitudinal direction of the main cartridge, wherein, in the longitudinal direction, the center position of the grip portion is disposed at the upstream side in the attachment direction of the sub cartridge from the center position of the main cartridge, the development device includes a development blade for regulating the thickness of the layer of the developer on a developer bearing member bearing the developer and a development blade sheet metal for supporting the development blade, and in the longitudinal direction, the center position of the development blade sheet metal is disposed at the upstream side in the sub cartridge attachment direction from the center position of the main cartridge.

23. A process cartridge used in an image forming apparatus, the process cartridge comprising:

a main cartridge attachable and detachable to and from the apparatus body of the image forming apparatus, and a sub cartridge attachable and detachable to and from the main cartridge, wherein the sub cartridge includes a developer container containing developer to be supplied to the main cartridge, the main cartridge includes a process device acting on a photosensitive member, a grip portion to be held by a user, and an attachment portion capable of attaching the sub cartridge along the longitudinal direction of the main cartridge, and in the longitudinal direction, the center position of the grip portion is disposed at the upstream side in the sub cartridge attachment direction from the center position of the main cartridge, and the cleaning device includes a cleaning blade and a cleaning blade sheet metal for supporting the cleaning blade, and in the longitudinal direction, the center position of the cleaning blade sheet metal is disposed at the upstream side in the sub cartridge attachment direction from the center position of the main cartridge.

24. A process cartridge used in an image forming apparatus, the process cartridge comprising:

a main cartridge attachable and detachable to and from the apparatus body of the image forming apparatus, and a sub cartridge attachable and detachable to and from the main cartridge, wherein the sub cartridge includes a developer container containing developer to be supplied to the main cartridge, the main cartridge includes a process device acting on a photosensitive member, a grip portion to be held by a user, and an attachment portion capable of attaching the sub cartridge along the longitudinal direction of the main cartridge, and in the longitudinal direction, the center position of the grip portion is disposed at the upstream side in the sub cartridge attachment direction from the center position of the main cartridge, the development device includes a development blade for regulating the thickness of the layer of the developer on a developer bearing member bearing the developer and a developer blade sheet metal for supporting the development blade, and in the longitudinal direction, the center position of the development blade sheet metal is disposed at the upstream side in the sub cartridge attachment direction from the center position of the main cartridge.

25. A process cartridge used in an image forming apparatus, the process cartridge comprising:

a main cartridge attachable and detachable to and from the apparatus body of the image forming apparatus, and a sub cartridge attachable and detachable to and from the main cartridge, wherein the sub cartridge includes a developer container containing developer to be supplied to the main cartridge, the main cartridge includes a process device acting on a photosensitive member, a grip portion to be held by a user, and an attachment portion capable of attaching the sub cartridge along the longitudinal direction of the main cartridge, and in the longitudinal direction, the center position of the grip portion is disposed at the upstream side in the sub cartridge attachment direction from the center position of the main cartridge, wherein the center of gravity of the main cartridge in the longitudinal direction where the sub cartridge is attached and the center of gravity of the main cartridge in the longitudinal direction where the sub cartridge is not attached are positioned inside the both ends of the grip portion.

26. A process cartridge used in an image forming apparatus, the process cartridge comprising:

a main cartridge attachable and detachable to and from the apparatus body of the image forming apparatus, and a sub cartridge attachable and detachable to and from the main cartridge, wherein the sub cartridge includes a developer container containing developer to be supplied to the main cartridge, the main cartridge includes a process device acting on a photosensitive member, a grip portion to be held by a user, and an attachment portion capable of attaching the sub cartridge along the longitudinal direction of the main cartridge, and in the longitudinal direction, the center position of the grip portion is disposed at the upstream side in the sub cartridge attachment direction from the center position of the main cartridge, wherein the center of gravity of the main cartridge in the longitudinal direction where a new sub cartridge having the developer container filled with the developer is attached, and the center of gravity of the main cartridge in the longitudinal direction where a used sub cartridge with a less amount of the filled developer than the new sub cartridge is attached, are positioned inside the both ends of the grip portion.

* * * * *